US006652350B1

(12) United States Patent
Phillips

(10) Patent No.: US 6,652,350 B1
(45) Date of Patent: Nov. 25, 2003

(54) AUTOMOBILE SEAT TOY

(76) Inventor: Charles Phillips, 180 W. End Ave., New York, NY (US) 10023

( * ) Notice: Subject to any disclaimer, the term of this patent is extended or adjusted under 35 U.S.C. 154(b) by 0 days.

(21) Appl. No.: 10/205,683

(22) Filed: Jul. 25, 2002

(51) Int. Cl.[7] ..... A63H 11/00; A63H 13/00; A63H 3/20

(52) U.S. Cl. ..... 446/330; 446/300; 446/338; 446/339; 446/384

(58) Field of Search ..... 446/330, 329, 446/384, 338, 339, 340, 300, 391, 901, 227

(56) References Cited

U.S. PATENT DOCUMENTS 1,782,786 A * 11/1930 Marx
3,456,950 A * 7/1969 Goldfarb
3,577,675 A * 5/1971 Kohner et al.
4,540,219 A * 9/1985 Klinger ..... 297/487
5,195,918 A * 3/1993 Mozes ..... 446/227
5,730,340 A * 3/1998 Bosic ..... 224/250
5,950,888 A * 9/1999 Nolan-Brown ..... 224/172
6,113,454 A * 9/2000 Mitchell ..... 446/227
6,183,335 B1 * 2/2001 Petersen ..... 446/227
6,224,450 B1 * 5/2001 Norton ..... 446/28

* cited by examiner

*Primary Examiner*—Derris H. Banks
*Assistant Examiner*—Ali Abdelwahed
(74) *Attorney, Agent, or Firm*—The Halverson Law Firm

(57) ABSTRACT

A toy for attachment to a motor vehicle seat. The toy comprising a head pivotally or fixedly mounted onto a base platform that is attached to a vehicle seat or headrest. There is an internal air actuate mechanism that, when actuated, forces the pivotally mounted head to turn in a predetermined direction. Additionally, the mouth moves and eyes illuminate as the head turns.

7 Claims, 7 Drawing Sheets

AUTOMOBILE SEAT TOY

FIELD OF THE INVENTION

The present invention generally relates to a toy for automobile seats. More specifically, the present invention is a fixed or movable head shaped device that may be attached to the automobile seat or headrest.

BACKGROUND OF THE INVENTION:

People spend an enormous amount of their time in an automobile. Some of this time is for the commute to work, while other portions of this time is driving to stores or business or friends homes. This driving can get a little tedious, in spite of the availability of radio broadcasts, tapes, compact disks and other listening media. Therefore, there is a need for novel devices that lighten the tedium of the driving chore and entertain the driver and/or passersby.

SUMMARY OF THE INVENTION

It is an object of the present invention to provide a device that lightens the tedium of the driving chore.

It is another object of the present invention to provide a toy that may be mounted on an automobile seat or headrest.

It is still another object of the present invention to provide a fixed or movable toy that may be mounted on an automobile seat or headrest.

It is yet another object of the present invention to provide a fixed or movable seat mounted toy that is in the shape of a head, whether human, animal or fictional character.

The novel features that are considered characteristic of the invention are set forth with particularity in the appended claims. The invention itself, however, both as to its structure and its operation together with the additional objects and advantages thereof will best be understood from the following description of the preferred embodiment of the present invention. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments of the invention is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS OF THE INVENTION

The present invention is a toy that is useful to reducing the tedium of driving an automobile.

The present invention is a toy 10 that attaches to an automobile seat or headrest, generally referred to as 5.

Figure 1B:
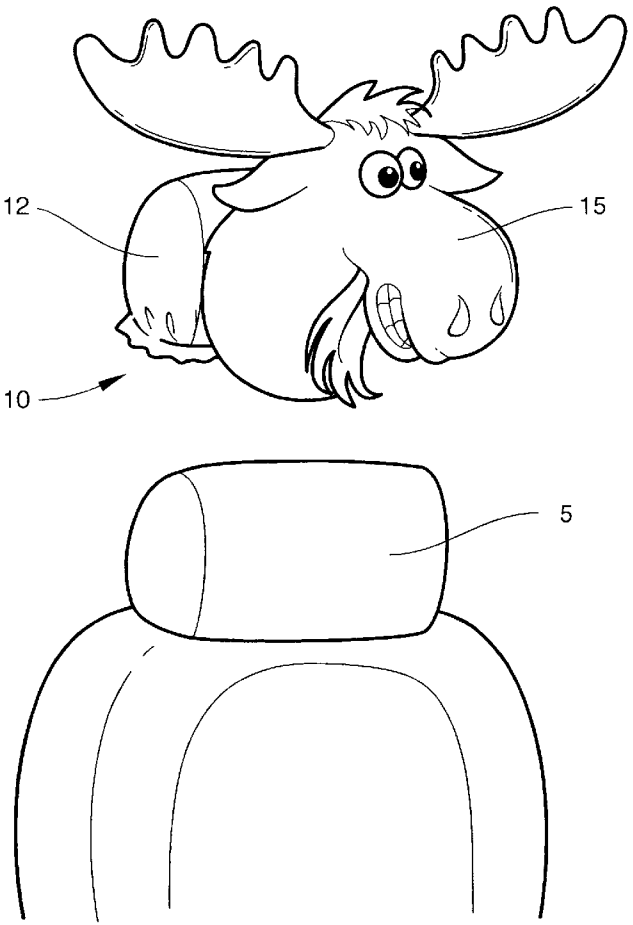
FIGS. 1A and 1B illustrate a fixed head version of the present invention in attached (1A) and unattached (1B) modes, respectively.
Figure 1A:
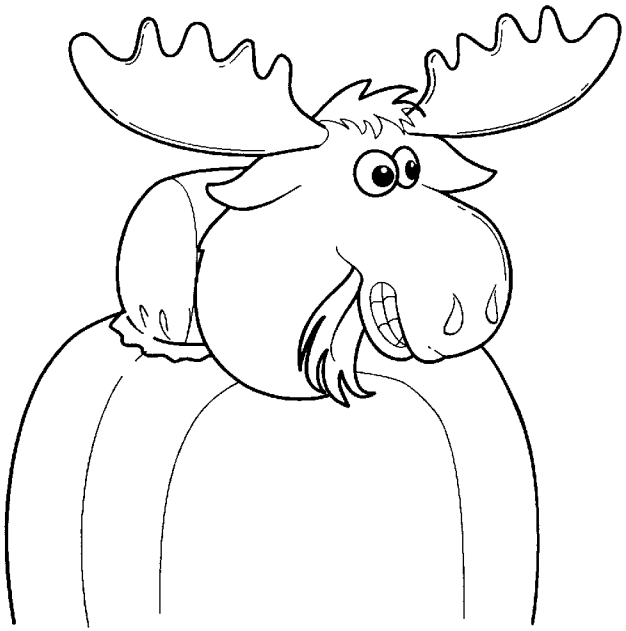
Figure 2B:
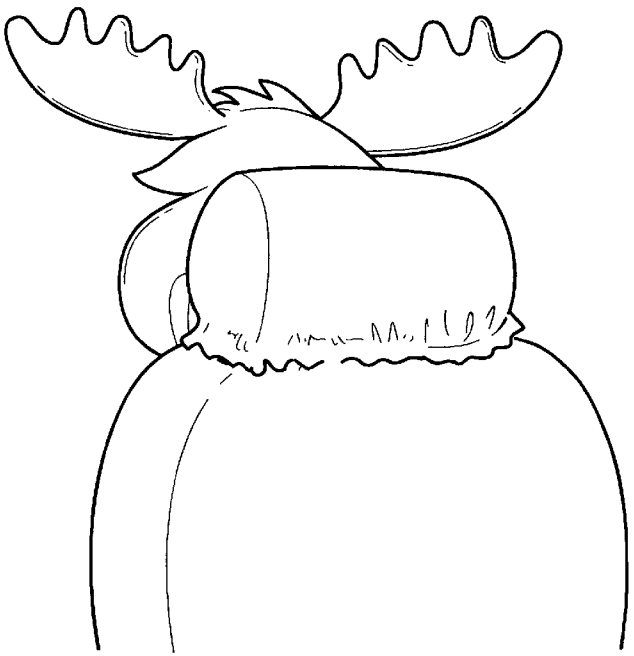
FIGS. 2A and 2B illustrate a rear view of the fixed head version of the present invention in attached (1A) and unattached (1B) modes, respectively.
Figure 2A:
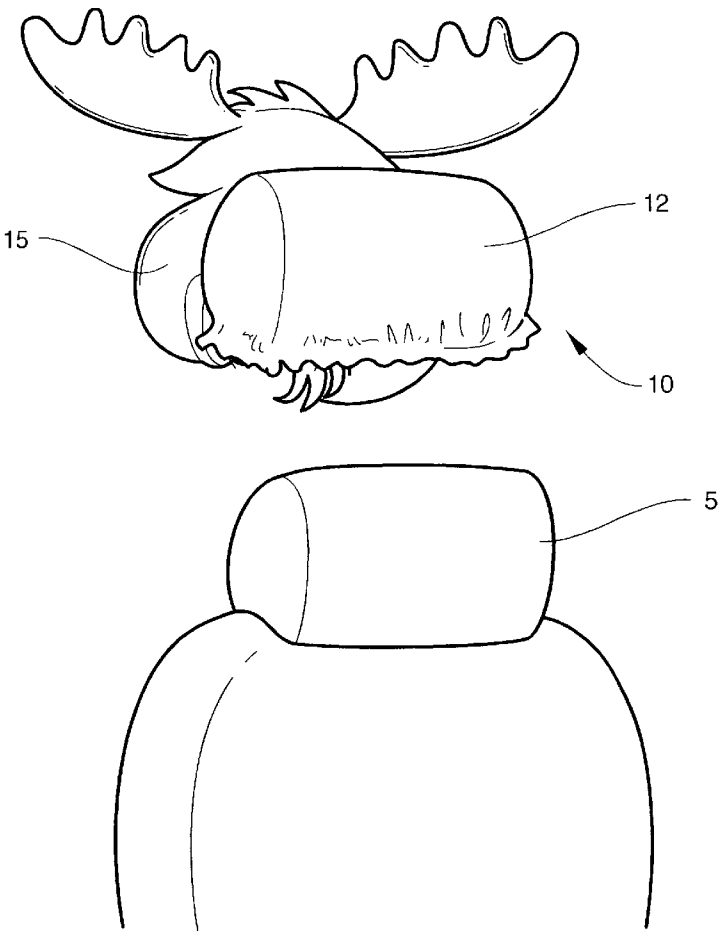
Figure 3A:
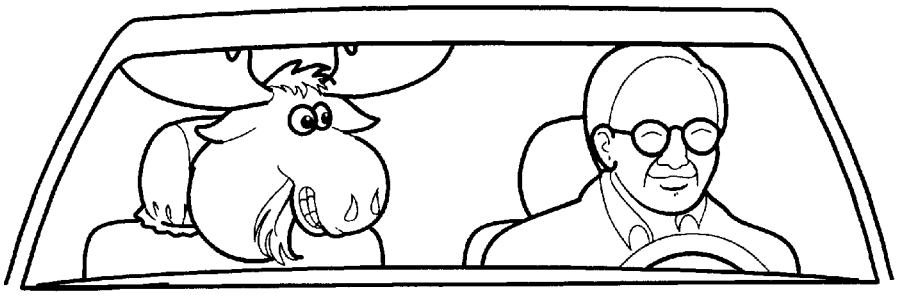
FIG. 3A is a perspective view of the present invention, in use with an occupant in the vehicle.
Figure 3B:
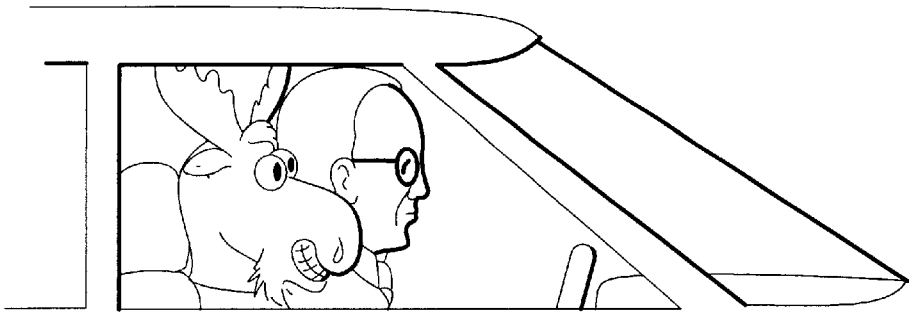
FIG. 3B is a side view of the present invention, in use with an occupant in the vehicle.
Figure 3C:
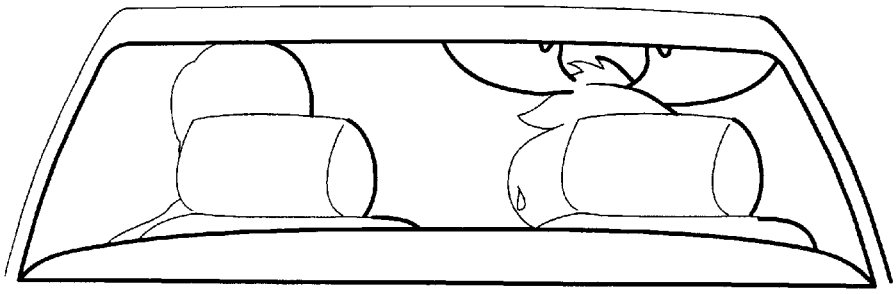
FIG. 3C is a rear view of the present invention, in use with an occupant in the vehicle.
Figure 3D:
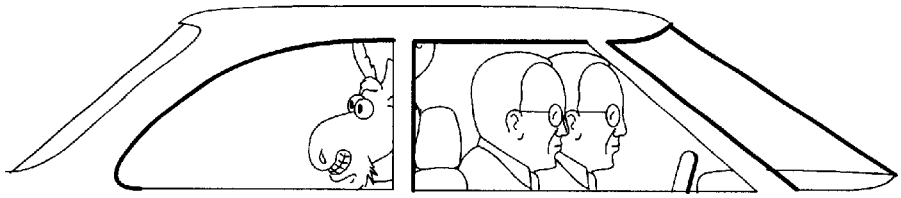
FIG. 3D illustrates how the present invention may be used when there are two passengers in the vehicle.

One embodiment of the present invention is a toy 10 that comprises a seat mount 12 fixedly attached to a head structure 15. In this embodiment the seat mount 12 may be a pouch like structure that fits over the top of the seat and/or headrest 5. In use, this embodiment of the toy 10 merely faces forward (or rearward as is illustrated in FIG. 3D) and provides the drivers and/or passengers who view the device with amusement.

An alternate embodiment of the present invention has the toy 10 comprising a base 20 that allows a movably attached head structure 15 to swivel and become animated when activated by an occupant of the automobile.

Figure 5:
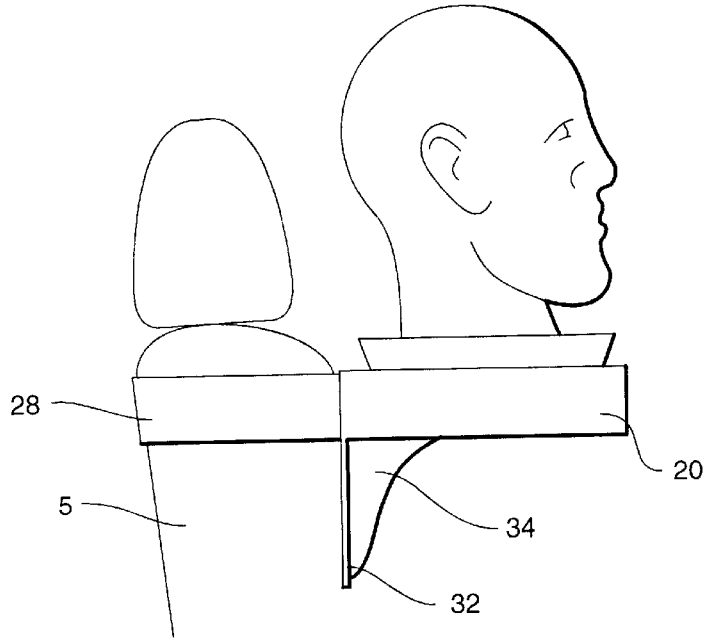
FIG. 5 illustrates a side view of the present invention, attached to a vehicle seat.
Figure 6:
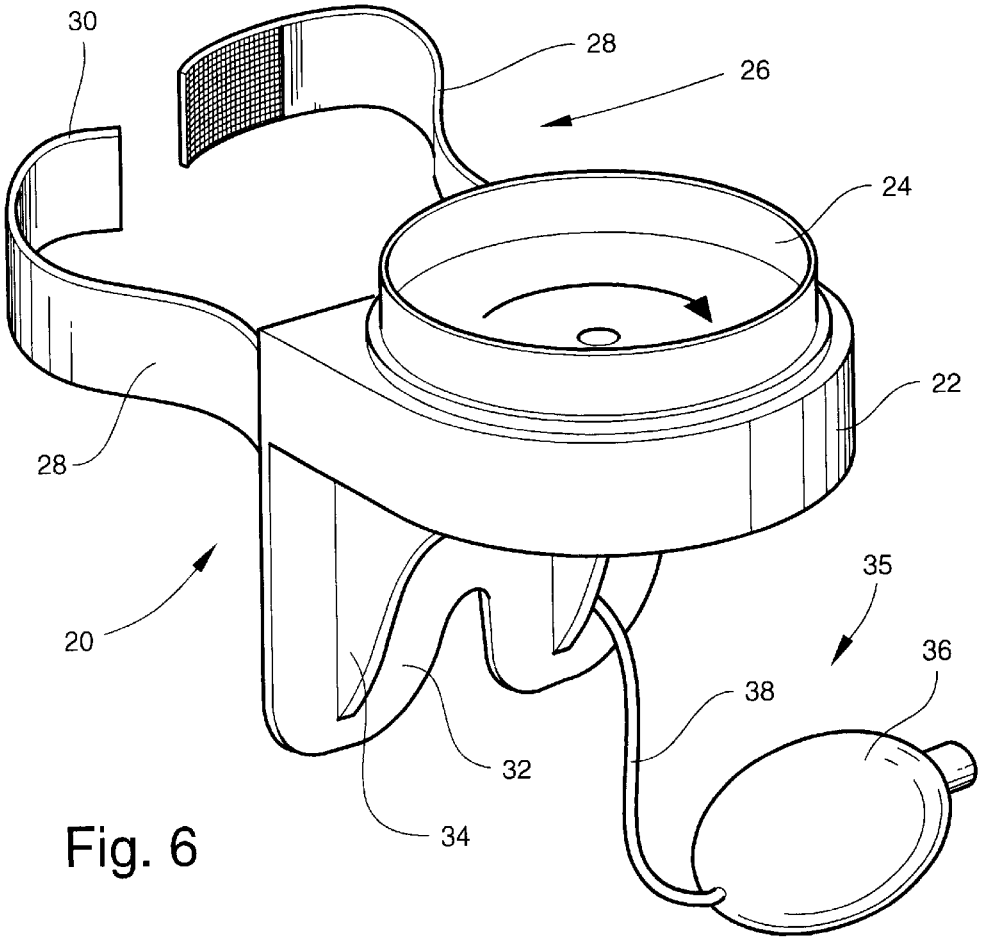
FIG. 6 illustrates a perspective view of the base without the head attached, clearly showing that the swivel unit of the base.
Figure 7:
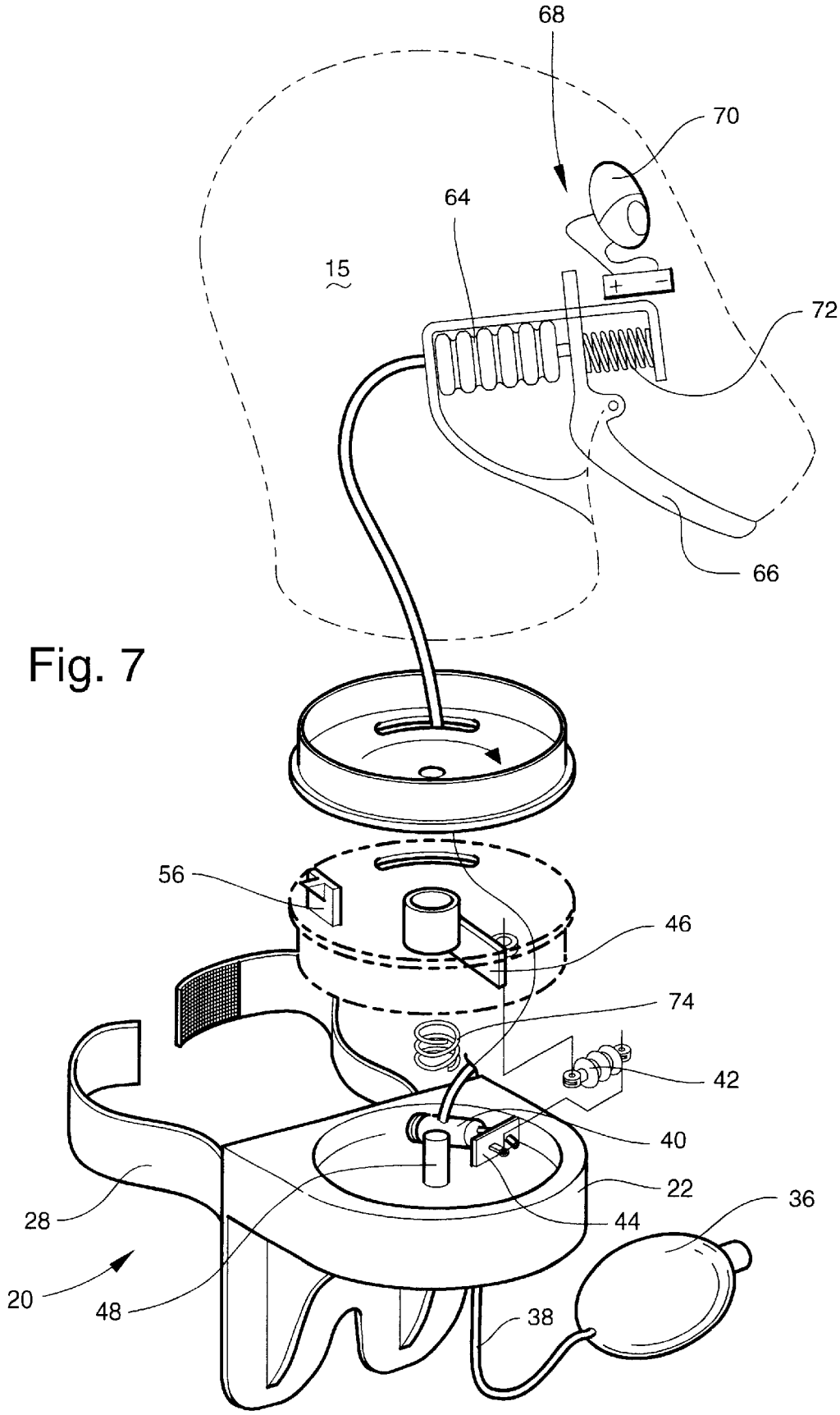
FIG. 7 is an exploded view according to the present invention.

As is more specifically illustrated in FIGS. 5 and 6, the base 20 comprises a base platform 22 with a swivel base 24 that is rotationally attached to the base platform 22. The base platform further comprises an attached seat mounting structure 26, such as straps, that allows the base 20 to be removably attached to the seat 5 of a motor vehicle.

There is a movement actuating system 35 that, in a preferred embodiment, comprises a rubber air bulb 36 attached to one end of a flexible hose 38. The other end of the flexible hose 38 is attached to a swivel actuating or valve mechanism 40 contained within the base platform 22.

Figure 8:
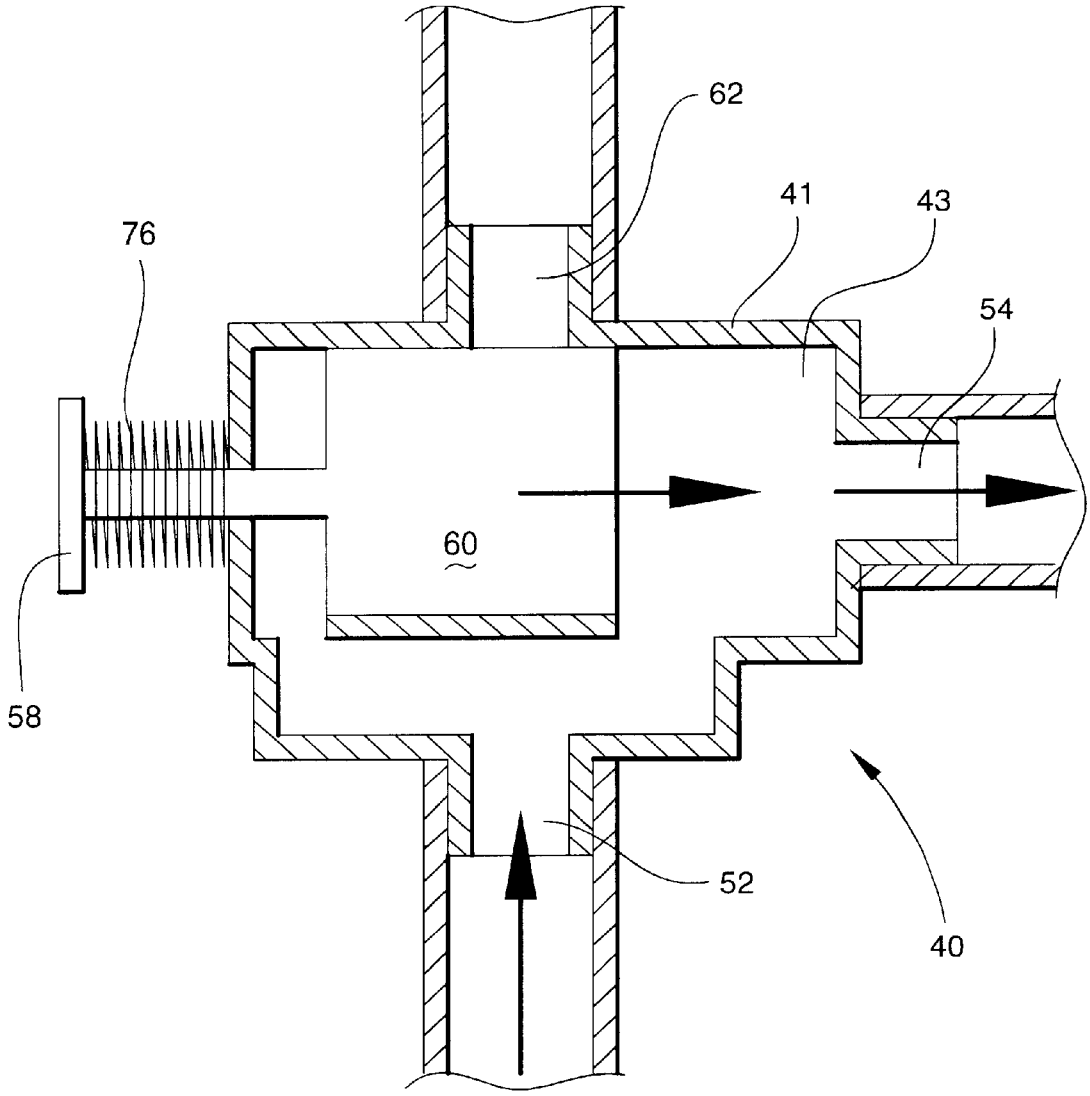
FIG. 8 is a sectional view of the preferred valve mechanism according to the present invention.

A preferred embodiment of the valve mechanism 40 is shown in greater detail in FIG. 8, and comprises a body 41 with a chamber 43 that contains a movable piston 60, which has an attached valve key 58 that moveably projects through a key port in the body 41 of the valve mechanism 40. The body 41 has a fluid input port 52, a first fluid output port 54 and a second fluid output port 62. The fluid input port 52 and first and second fluid output ports 54 and 62 are located in the body of the valve mechanism 40 such that when the piston 60 is in a first position (shown in the figure) fluid entering the fluid input port 52 exits through the first fluid output port 54 only and when the piston 60 is in a second position (not shown in the figure), fluid entering the fluid input port 52 exits through the second fluid output port 62 only. The piston 60 is movable from the first and second position by actuation of the valve key 58. It should be remembered that other valve systems may be used and still fall within the scope of the present invention.

In use the air bulb 36 is squeezed, thereby creating airflow within the flexible hose 38, which transports the flowing air through the valve mechanism 40 to a first bellows 42. Expansion of the first bellows 42 between first and second structures 44 and 46 causes the second structure 46, which is attached to the swivel base 24, to pivot the swivel base 24 in a predetermined direction (preferably clockwise as illustrated in the figure) about a central shaft 48. As the swivel base 24 pivots about the central shaft 48, the head structure 15, which is attached to the swivel base 24 appears to turn.

As the swivel base 24 turns a tab 56, which is attached to the swivel base 24, contacts the valve key 58 located in the valve mechanism 40. This contact of the valve key 58 pushes the attached piston 60 toward the first output port 54, thereby redirecting airflow to a second output port 62, which causes inflation of a second bellows 64, which is attached between the head structure 15 and a jaw structure 66. Inflation of the second bellows 64 causes the jaw structure 66, which is pivotally attached to the head structure 15, to move (drop). When the jaw structure 66, which is pivotally attached to the head structure 15. drops it completes an electrical circuit 68, comprising a power source such as a battery that is in electrical contact with a pair of light emitting diodes (LEDs) contained within the eyes 70, thereby causing the eyes 70, which are attached to the head structure 15, to illuminate.

The overall observed effect of actuation of the air bulb 36 is for the head 15 to turn clockwise toward the vehicle window, then opening its mouth (jaw 66) and illuminating its eyes 70.

Once the air bulb 36 is released, first and second springs 74 and 72 compress the first and second bellows 42 and 64. There is also a third spring 76 that returns the piston 60 from the second position to the first position, when the air bulb 36 is released.

In a preferred embodiment, the seat mounting structure 26 is a pair of flexible straps 28 that fit around the vehicle seat or head rest and attach to each other via a fastening structure 30, such as hook and loop fasteners. There may be a stabilizing arm 32 that extends below the base platform 22. In a preferred embodiment, the stabilizing arm 32 has a flat side for resting against the vehicle seat 5 and is located on one side of the base platform 22 and may include at least one structural support member 34.

Figure 4A:
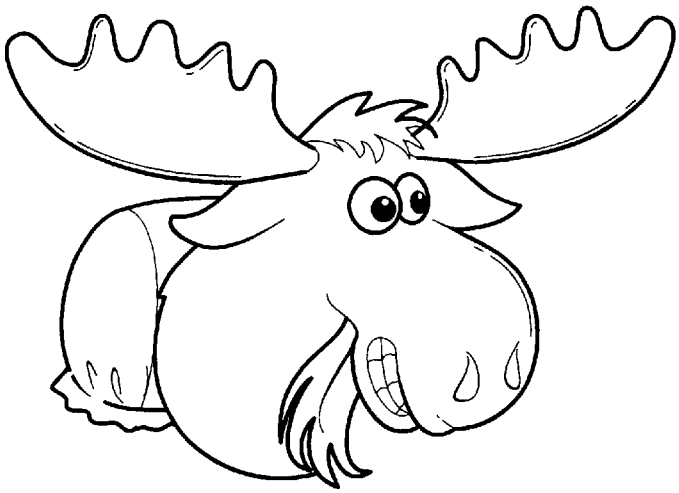
FIGS. 4A, 4B and 4*c* illustrate that a variety of different head shapes and designs may be used with the present invention and still fall within the scope of the present invention.
Figure 4B:
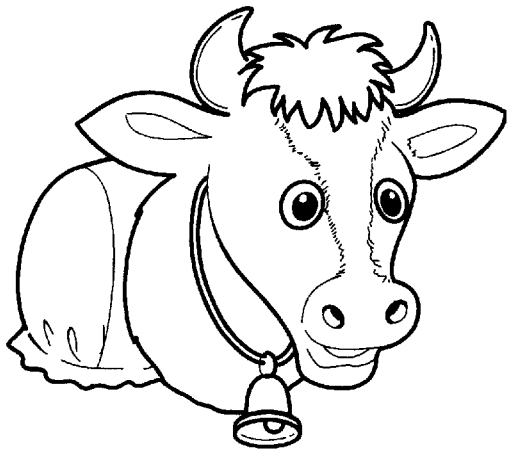
Figure 4C:
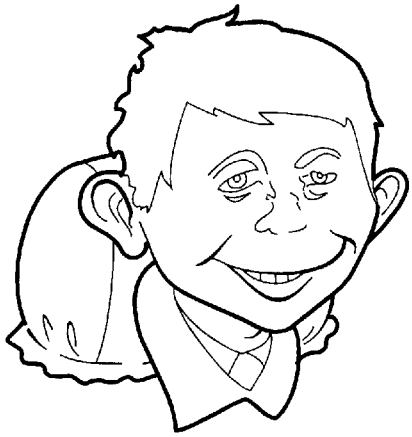

The head structure 15 can be made from a variety of different materials, but is preferably made from a plush, rubber or plastic surface and may be in the shape of a person, animal, fictional character (such as a cartoon or comic character) as is illustrated in FIGS. 4A, 4B and 4C.

The preferred embodiment of the invention is described above in the Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventors that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A toy for use with motor vehicles comprising:

a. an automobile seat attachable base having a base platform with a rotationally attached swivel base, and b. a head structure attached to the swivel base, and c. a movement actuating system that moves the head structure relative to the base platform, wherein the movement actuating system comprises a valve mechanism in fluid communication with a valve actuator and a first bellows in fluid communication with the valve mechanism, said first bellows being attached between the base platform and the swivel base where expansion or contraction of the first bellows causes the swivel base to rotate relative to the base platform.

2. The toy according to claim 1 wherein the movement actuating system further comprises a second bellows that is in fluid communication with the valve mechanism and that is attached between a jaw structure, which is pivotally attached to the head structure, where expansion or contraction of the second bellows causes the pivotally attached jaw structure to pivot relative to the head structure.

3. The toy according to claim 2 wherein the movement actuating system further comprises eyes that are attached to the head structure where movement of the jaw structure completes an electrical circuit and thereby causes the eyes to illuminate.

4. The toy according to claim 3 wherein the valve actuator comprises an air bulb in fluid communication with the valve mechanism.

5. A toy for use with motor vehicles comprising:

a. an automobile seat attachable base having a base platform with a rotationally attached swivel base, b. a head structure attached to the swivel base, c. a movement actuating system that moves the head structure relative to the base platform, i. the movement actuating system comprises a valve mechanism in fluid communication with a valve actuator comprising an air bulb in fluid communication with the valve mechanism and a first bellows in fluid communication with the valve mechanism, said first bellows being attached between the base platform and the swivel base where expansion or contraction of the first bellows causes the swivel base to rotate relative to the base platform ii. there is a second bellows that is in fluid communication with the valve mechanism and that is attached between a jaw structure, which is pivotally attached to the head structure, where expansion or contraction of the second bellows causes the pivotally attached jaw structure to pivot relative to the head structure, iii. there are eyes that are attached to the head structure where movement of the jaw structure completes an electrical circuit and thereby causes the eyes to illuminate, iv. said valve mechanism comprising a body with a chamber that contains a movable piston, which has an attached valve key that moveably projects through the body of the valve mechanism, the body has a fluid input port, a first fluid output port and a second fluid output port, the fluid input port and first and second fluid output ports being located in the body of the valve mechanism such that when the piston is in a first position fluid entering the fluid input port exits through the first fluid output port only and when the piston is in a second position, fluid entering the fluid input port exits through the second fluid output port only, said piston being movable from the first and second position by use of the valve key.

6. The toy according to claim 5 wherein the valve mechanism is located in the base platform and the swivel base has a tab that when the swivel base rotates relative to the base platform contacts the valve key, thereby depressing the valve key and moving the piston from the first position to the second position.

7. The toy according to claim 6 further including a first restoring force mechanism attached between the base platform and the swivel base, said first restoring force mechanism capable of returning the first bellows from an expanded to a compressed configuration when the air bulb is released, a second restoring force mechanism attached between the head structure and the second bellows, said second restoring force mechanism capable of returning the second bellows from an expanded to a compressed configuration when the air bulb is released, and a third restoring force mechanism, said third restoring force mechanism capable of returning the piston from the second position to the first position when the air bulb is released.

* * * * *